US005333003A

United States Patent [19]

Archer

[11] Patent Number: 5,333,003

[45] Date of Patent: Jul. 26, 1994

[54] LAMINATED COMPOSITE SHELL STRUCTURE HAVING IMPROVED THERMOPLASTIC PROPERTIES AND METHOD FOR ITS FABRICATION

[75] Inventor: John S. Archer, Brownfield, Tex.

[73] Assignee: TRW Inc., Redondo Beach, Calif.

[21] Appl. No.: 823,419

[22] Filed: Jan. 21, 1992

[51] Int. Cl.[5] ..... H01Q 15/14; H01Q 1/36

[52] U.S. Cl. ..... 343/914; 343/897

[58] Field of Search ..... 343/912, 914, 897

[56] References Cited

U.S. PATENT DOCUMENTS

| | | | |
|---|---|---|---|
| 2,682,491 | 6/1954 | Hahn | 154/110 |
| 4,001,836 | 1/1977 | Archer et al. | 343/756 |
| 4,092,453 | 5/1978 | Jonda | 343/897 |
| 4,191,604 | 3/1980 | MacTurk | 156/245 |
| 4,575,726 | 3/1986 | Gounder | 343/756 |
| 4,635,071 | 1/1987 | Gounder et al. | 343/897 |
| 4,689,637 | 8/1987 | Ochiai et al. | 343/914 |
| 4,743,919 | 5/1988 | Chang et al. | 343/914 |
| 4,812,854 | 3/1989 | Boan et al. | 343/897 |
| 4,868,580 | 9/1989 | Wade | 343/912 |

*Primary Examiner*—Gregory C. Issing

*Attorney, Agent, or Firm*—James M. Steinberger; Sol L. Goldstein

[57] ABSTRACT

A laminated composite shell structure having quasi-isotropic thermal expansion and contraction characteristics and a method for its fabrication. The laminated composite shell structure includes multiple layers of overlapping strips of composite material conforming to an axisymmetric doubly-curved surface. The fibers in the multiple layers are arranged at different relative angular orientations, with the composite strips being shaped to maintain the fibers at a constant relative angular orientation throughout the shell structure.

10 Claims, 6 Drawing Sheets

LAMINATED COMPOSITE SHELL STRUCTURE HAVING IMPROVED THERMOPLASTIC PROPERTIES AND METHOD FOR ITS FABRICATION

This application is related to an abandoned application by the same inventor entitled "Method for Fabricating and Applying Strips to a Curved Three-Dimensional Surface," Ser. No. 06/923,252, filed on Oct. 27, 1986.

BACKGROUND OF THE INVENTION

This invention relates generally to composite shell structures, such as antenna reflectors, and their methods of fabrication and, more particularly, to laminated composite shell structures that are fabricated from multiple layers of overlapping strips of composite material.

Antenna reflectors deployed on orbiting spacecraft are subjected to wide temperature variations due to the alternate extremes of direct sunlight and total darkness encountered in orbit. An antenna reflector must be able to withstand the thermal stresses induced by these wide temperature variations without undergoing large distortions in shape. Distortions in the high-precision three-dimensional surface contour of an antenna reflector cause a loss in signal strength and possible loss of information, particularly for large reflectors or high frequency signals. An antenna reflector intended for use in space, therefore, should be rigid, strong and lightweight and have good thermoelastic properties.

One type of shell construction that is rigid, strong and lightweight is a laminated composite shell structure fabricated from multiple layers of overlapping strips of composite material, such as unidirectional graphite fiber reinforced epoxy tapes. The mechanical properties of a laminated composite shell structure, such as strength, stiffness and thermoelasticity, are largely determined by the type of composite material and the relative angular orientation of the fibers in the multiple layers. Strength and stiffness are maximized by orienting the fibers in the multiple layers at different angles, such as 0° and 90°, or 0° and ±60°. Thermoelasticity is minimized by using a composite material with a low coefficient of thermal expansion and constructing the shell structure such that any thermal expansion or contraction is quasi-isotropic. Quasi-isotropic expansion and contraction is provided by maintaining the relative angular orientation of the fibers in the multiple layers at their selected angles within a small tolerance throughout the shell structure.

If a shell structure conforming to a three-dimensional doubly-curved surface is relatively flat, the angular orientation of the fibers in the multiple layers remains the same within an acceptable tolerance throughout the shell structure. However, if a shell structure conforming to a doubly-curved surface has some curvature, large deviations result in the angular orientation of the fibers in the multiple layers. For example, if two layers of constant width strips are oriented at angles of 0° and 90° at the vertex of a parabolic antenna reflector having an F/D (focal length to diameter ratio) ratio of 0.25, the strips will intersect at angles from 70° to 110° at different locations along the periphery of the reflector. This is an excessive deviation from the desired 90° orientation. Accordingly, there has been a need for a laminated composite shell construction that does not suffer from these large deviations in fiber orientation. The present invention is directed to this end.

SUMMARY OF THE INVENTION

The present invention resides in a laminated composite shell structure having quasi-isotropic thermal expansion and contraction characteristics and a method for its fabrication. The laminated composite shell structure includes multiple layers of overlapping strips of composite material conforming to an axisymmetric doubly-curved surface. The fibers in the multiple layers are arranged at different relative angular orientations, with the composite strips being shaped to maintain the fibers at a constant relative angular orientation throughout the shell structure.

The method for fabricating the laminated composite shell structure of the present invention includes generating a three-dimensional strip pattern conforming to the axisymmetric doubly-curved surface. The strip pattern can be rotated any angle about the vertex of the curved surface relative to an identical fixed strip pattern with the centerlines of the strips in the rotated pattern intercepting the centerlines of the strips in the fixed pattern at the same angle and at the angle of rotation. The three-dimensional strip pattern can either be developed onto a planar surface to provide a planar strip pattern or the planar strip pattern can be cut directly on a three-dimensional mold of the shell structure having the strip pattern inscribed on its surface. The planar strip pattern provides a template for cutting the composite strips, which are then laid in place, strip by strip and layer by layer, on the three-dimensional mold and cured in an autoclave.

It will be appreciated from the foregoing that the present invention represents a significant advance in the field of composite shell construction. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1A:
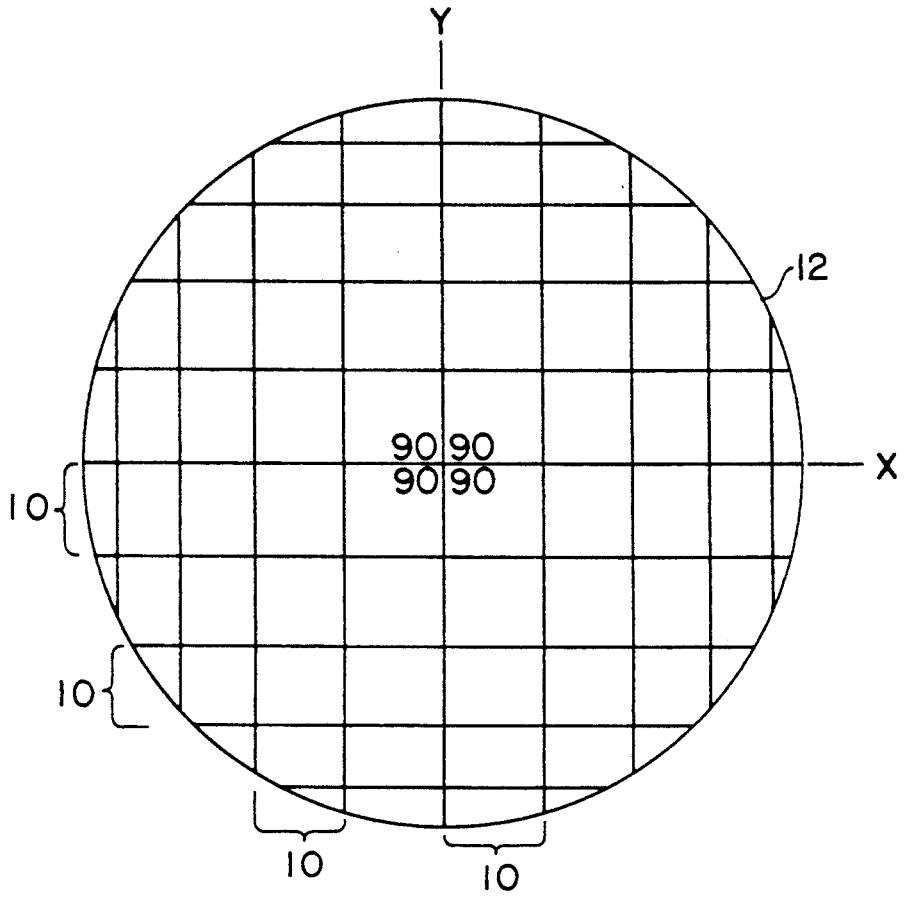
FIG. 1a PRIOR ART
FIGS. 1*a*–1*b* are planform and elevation views of an antenna reflector of the prior art having composite strips that intersect at angles from 70° to 110° at different locations along the periphery of the reflector.
Figure 1B:
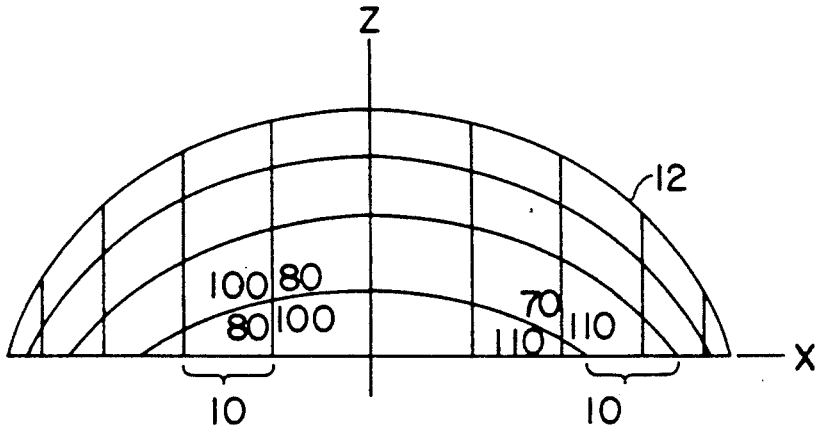
FIG. 1b PRIOR ART

As shown in the drawings for purposes of illustration, the present invention is embodied in a laminated composite shell structure having quasi-isotropic thermal expansion and contraction characteristics and a method for its fabrication. As illustrated in FIGS. 1*a*–1*b*, two layers of constant width strips 10 are oriented at angles of 0° and 90° at the vertex of a parabolic antenna reflector 12 having an F/D (focal length to diameter ratio) ratio of 0.25. Because of the curvature of the reflector 12, the strips 10 intersect at angles from 70° to 110° at different locations along the periphery of the reflector. This is an excessive deviation from the desired 90° orientation, causing any thermal expansion or contraction of the reflector 12 to be nonisotropic, thus severely degrading the thermoelastic properties of the reflector.

In accordance with the shell construction of the present invention, the laminated composite shell structure includes multiple layers of overlapping strips of composite material conforming to an axisymmetric doubly-curved surface. The fibers in the multiple layers are arranged at different relative angular orientations, with the composite strips being shaped to maintain the fibers at a constant relative angular orientation throughout the shell structure.

The method for fabricating the laminated composite shell structure of the present invention includes generating a three-dimensional strip pattern conforming to the axisymmetric doubly-curved surface. The strip pattern can be rotated any angle about the vertex of the curved surface relative to an identical fixed strip pattern with the centerlines of the strips in the rotated pattern intercepting the centerlines of the strips in the fixed pattern at the same angle and at the angle of rotation. The three-dimensional strip pattern can either be developed onto a planar surface to provide a planar strip pattern or the planar strip pattern can be cut directly on a three-dimensional mold of the shell structure having the strip pattern inscribed on its surface. The planar strip pattern provides a template for cutting the composite strips, which are then laid in place, strip by strip and layer by layer, on the three-dimensional mold and cured in an autoclave.

Figure 2:
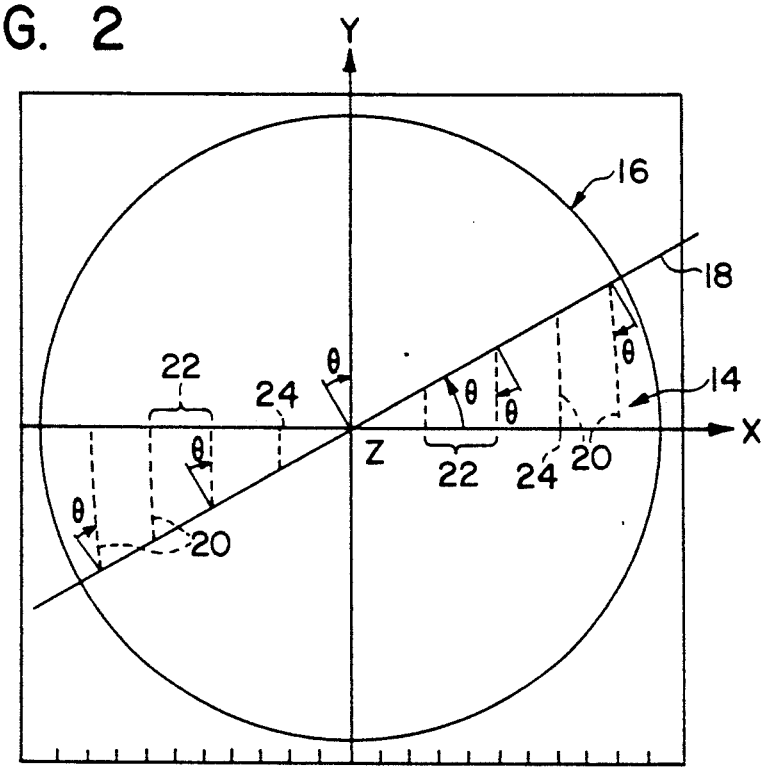
FIGS. 2–4 are planform views showing the method for generating a three-dimensional strip pattern in accordance with the present invention.
Figure 3:
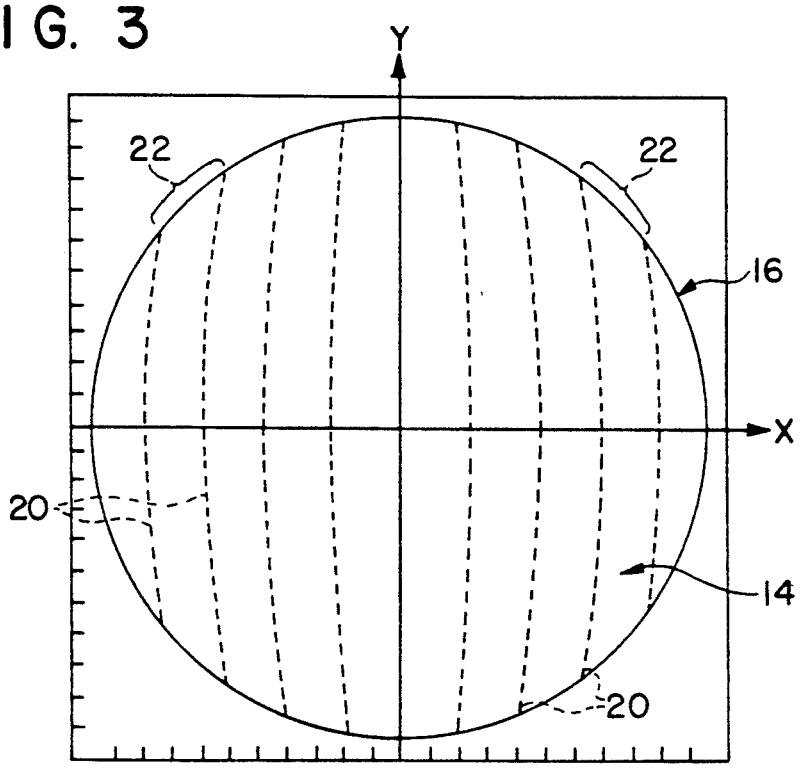

As illustrated in FIGS. 2–3, a three-dimensional strip pattern 14 is generated on an axisymmetric doubly-curved surface 16 conforming to the front surface of the shell structure. The strip pattern 14 is generated on the curved surface 16 such that the local angle of intersection between a plane 18 at any angle Θ and each of a set of lines 20 defining strips 22 is equal to the angle Θ that the plane 18 makes with the X-axis of the strip pattern 14. The local angle of intersection is defined as the angle measured in the plane of tangency to the curved surface 16 between a normal to the plane 18 and the tangent to the line 20 at the point of intersection. Plane 18 includes the Z-axis, which is the vertex or axis of symmetry of the curved surface 16.

In FIG. 2, plane 18 is shown rotated an angle Θ about the Z-axis counterclockwise from the XZ plane. As Θ is varied from 0° to 90°, the set of lines 20 is constructed on the doubly-curved surface 16 extending from initial positions 24 on the surface in the XZ plane. Each line 20 is extended from its initial position 24 by incrementally adding infinitesimal segments on the curved surface 16 such that these segments intersect the plane 18 at the angle Θ. The axisymmetric doubly-curved surface 16 can be a surface that is defined by mathematical equations, such as parabolic or hyperbolic surfaces, or a surface that is defined by offset data. The three dimensional coordinates of the strip pattern 14 can be calculated in rectangular or spherical coordinates and are calculated at regular intervals of the angle Θ from 0° to 90°.

Figure 4:
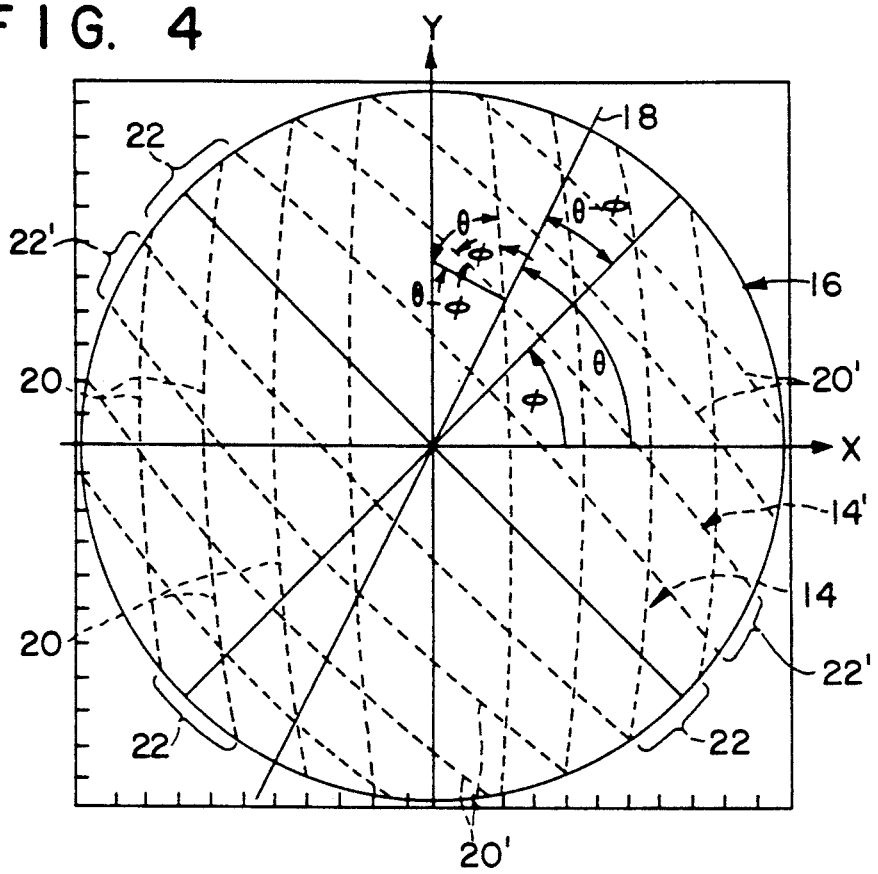

As illustrated in FIG. 4, when the strip pattern 14 is rotated any angle about the vertex of the curved surface 16 relative to an identical fixed strip pattern, a set of lines 20' defining strips 22' in the rotated pattern 14' intercept the set of lines 20 defining the strips 22 in the fixed pattern 14 at the same angle and at the angle of rotation. Although the centerlines of the strips 22, 22' are not shown in FIGS. 2–4 for clarity, the centerlines are generated in the same manner as the set of lines 20, 20', and therefore also intersect at the same angles.

Consider the point of intersection of any line 20' in the rotated pattern 14' with any line 20 in the fixed pattern 14 and let the plane 18 pass through this point. Each line 20 in the fixed pattern 14 intersects plane 18 at the angle Θ and each line 20' in the rotated pattern 14' intersects plane 18 at the angle Θ−Φ. The angle between these lines 20, 20' is Θ−(Θ−Φ), or Φ. Therefore, the three-dimensional strip pattern 14 provides fixed and rotated strip patterns 14, 14' that are defined by a set of lines 20, 20' that intersect everywhere at the same local angle Θ, which is defined as the angle between the tangents of the intersecting lines at the point of intersection.

Figure 5:
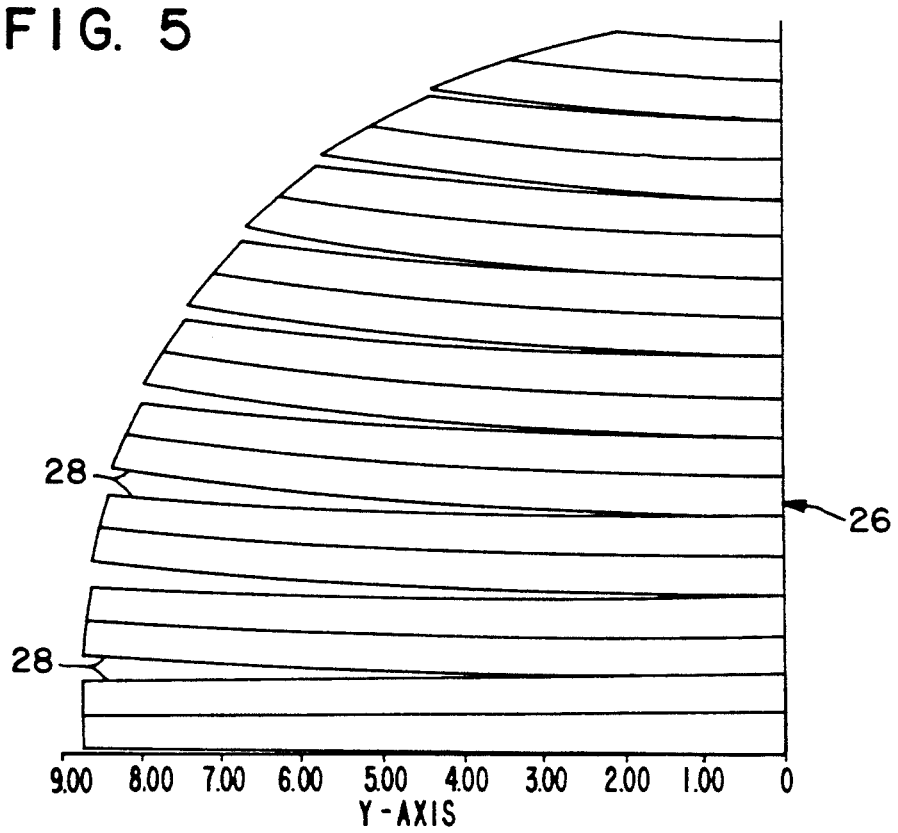
FIG. 5 is a planform view of a planar strip pattern for one-quarter of the shell structure.
Figure 6A:
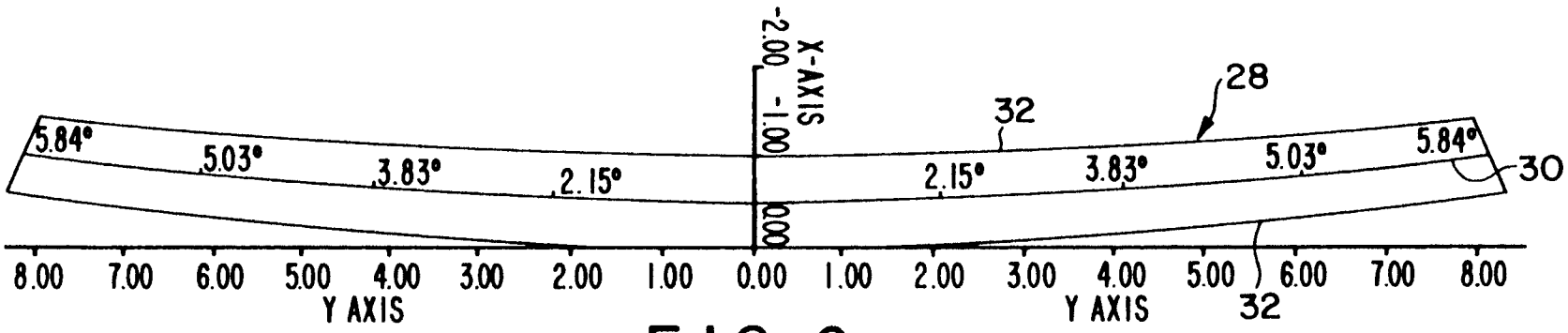
FIG. 6*a* is a planform view of a strip pattern for a single composite strip and FIG. 6*b* is a planform view of a single composite strip.

The three-dimensional strip pattern 14 can either be developed onto a planar surface to provide a planar strip pattern 26, as shown in FIG. 5, or the planar strip pattern 26 can be cut directly on a three-dimensional mold of the shell structure having the strip pattern 14 inscribed on its surface. A method for developing the three-dimensional strip pattern 14 onto a planar surface is discussed later. As shown in FIG. 6*a*, each single strip pattern 28 of the planar strip pattern 26 is formed by three adjacent lines, a centerline 30 and two outer lines 32 that form the edges of the strip pattern 28. The ends of the strip pattern 28 are the XZ plane and the periphery of the shell structure. Slight adjustments are typically made to the shapes of each strip pattern 28 at the periphery end to compensate for three-dimensional distortions caused by the finite width of the strip patterns. Each strip pattern 28 is defined by Y coordinates and the angle of a tangent line drawn at the centerline 30 of the strip, pattern 28 at each Y coordinate. The X- and Y-axes are measured in inches.

Figure 6B:
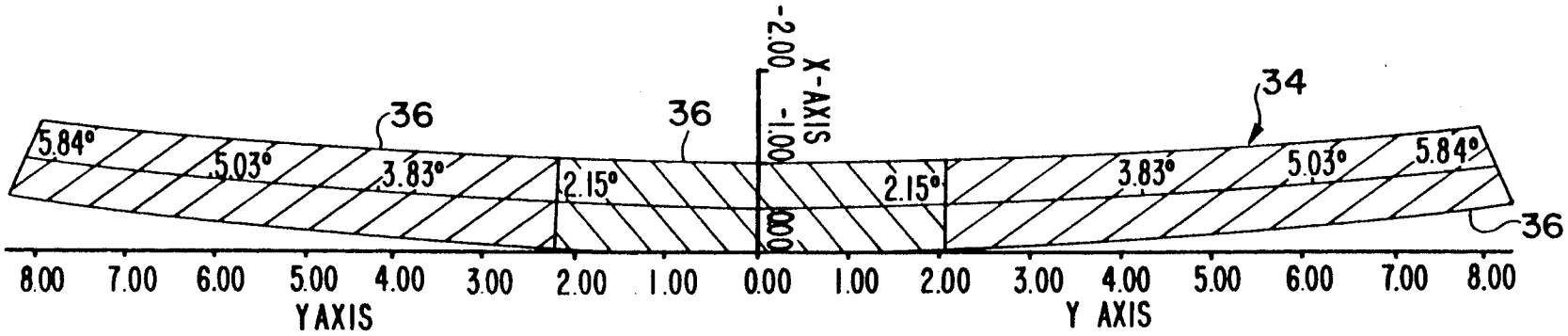

The planar strip patterns 28 provide a template for cutting planar strips 34 of composite material, as shown in FIG. 6*b*. The composite material is preferably a prepreg of a unidirectional graphite fiber tape impregnated with an epoxy resin, but the composite material can also be a woven fabric. Because the fibers in the graphite tape are straight, each composite strip 34 must be fabricated with piecewise straight segments 36 of composite material. The length of each segment 36 is determined by the curvature of the centerline 30 of the strip pattern 28 and the tolerance allowed in the alignment of the fibers. The tighter the tolerance, the shorter each segment 36 must be due to the angular deviation of the fibers along the Y-axis. FIG. 6*b* shows a three segment strip 34 having a tolerance of ±2°, which allows an angular deviation along each segment 36 of no more than about 4°. The tolerance is a function of the width of the composite strips 34 and the flatness of the shell structure, or F/D ratio. Narrow strips have less angular deviation but require more measurements and cutting. A flat surface or large F/D ratio allows the composite strips to be wider.

The composite strips 34 are then laid in place, strip by strip and layer by layer, on the three-dimensional mold. The composite strips 34 must be parallel, with the edges of adjacent strips abutting each other. Each strip 34 extends completely across the shell structure from one edge to the other. The layers may be bonded with or without an adhesive layer between the layers, since the tacky resin in the prepreg serves as the adhesive, if desired. Overlapping layers are oriented at angles such as 0° and 90°, or 0° and ±60°. The assembly is then cured at an elevated temperature and pressure in an autoclave using any conventional curing process. The shell structure is then coated with a metal layer if the structure is to be used as an antenna reflector.

Figure 7:
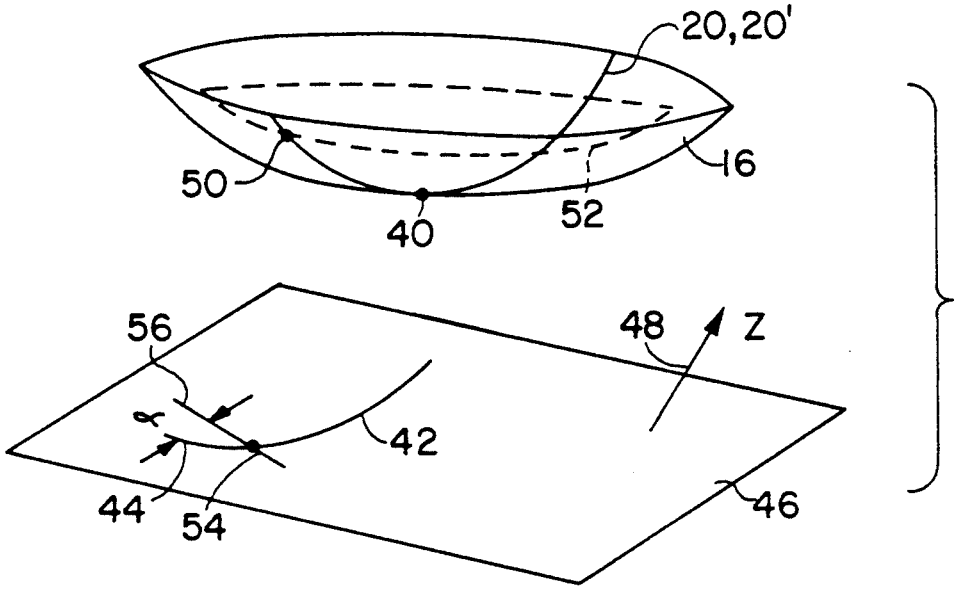
FIG. 7 is a diagrammatic view showing the process of development of a line from a doubly-curved surface onto a planar surface, in accordance with one aspect of the invention.

A method for developing the three-dimensional strip pattern 14 onto a planar surface is now presented. The development of a line 20, or line 20', located on a doubly-curved surface 16 onto a planar surface is depicted in simplified form in FIG. 7. The doubly-curved surface 16 must defined by some mathematical function, so the line 20 is also mathematically defined. A reference point 40 is indicated as being located on the line 20 in the curved surface 16, and a corresponding reference point 42 is indicated on line 44 in a reference plane 46. The reference plane 46 is normal to a preselected reference direction, indicated at 48 and referred to as the Z-axis. The direction of the Z-axis may be selected arbitrarily, but normally a direction is selected which results in developed lines that are conveniently oriented for fabrication.

Figure 8:
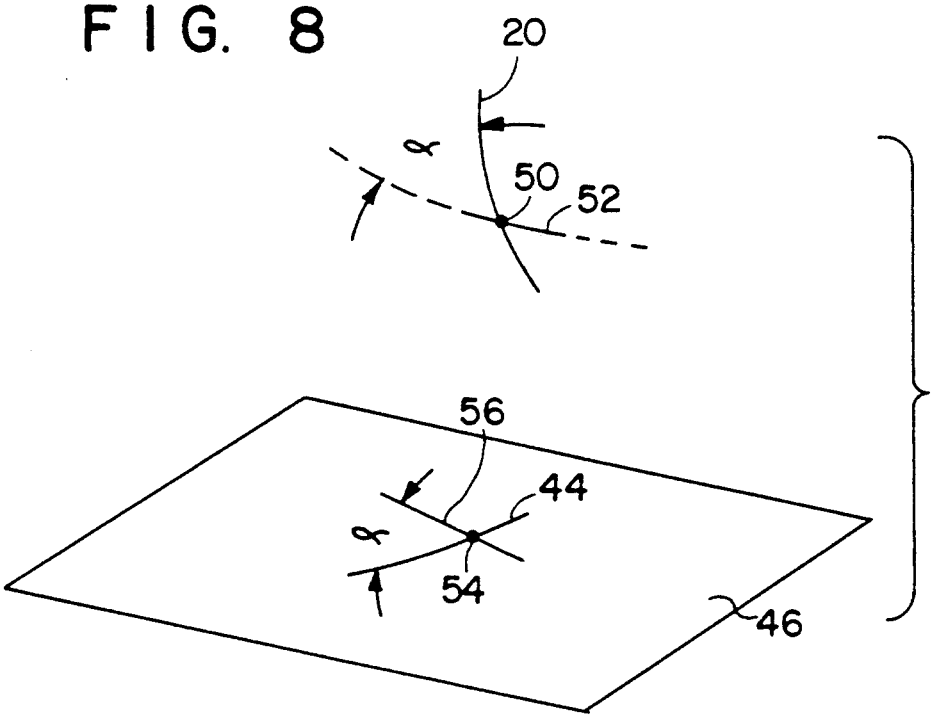
FIG. 8 is a view similar to FIG. 1, but showing in greater detail the development of a portion of the line onto the planar surface.

At a point 50 on the line 20, the line intersects a curve 52 that is drawn at a constant distance or "altitude" above the reference plane 46. If the plane 46 is normal to the Z-axis direction, the curve 52 may also be referred to as a constant-Z curve or meridian. FIG. 8 shows the point of intersection 50 between the line 20 and the constant-Z curve 52 in more detail. Point 54 in the reference plane 46 corresponds to the intersection point 50 in the curved surface 16, and curve segment 56 in the reference plane corresponds to a segment of curve 52 in the curved surface. Segment 56 is parallel to the segment of curve 52 at the point 50 under consideration.

The process of development of the line 20 onto the reference plane 46 may be defined by just two constraints. First, the distance from point 54 to reference point 42 on the developed line 44 must be equal to the corresponding distance between the original point 50 and the reference point 40 on the line 20. The other constraint is that the angle between the line 20 and the constant-Z curve 52 in the curved surface 16 is equal to the angle between the developed line 44 and the line segment 56 in the reference plane 46, for all corresponding points along the curved and developed lines. In the illustrative case, the angle between the line 20 and the segment of curve 52 at point 50 is indicated as $\alpha$. This angle is also maintained between the developed line 44 and the curve segment 56 at the point 54 on the developed line 44.

The physical significance of this angular equivalence can perhaps be best understood by considering the process of applying a strip containing the developed line onto the curved surface. At any instant when the strip is being unrolled onto the curved surface, one may consider that the portion not yet in contact with the surface is being folded or rotated about the segment of the constant-Z curve 52. Likewise, when the strip is being unfolded onto the reference plane 46 it may be thought of as being rotated about the corresponding constant-Z line segment 56. For this process to proceed consistently, the angle $\alpha$ between the line segment and the constant-Z line will be the same for corresponding points in the curved and developed lines.

Development is a stepwise procedure in which the length of the developed line measured from a reference point is maintained equal to the corresponding length of the line in the curved surface, and in which, at each step, the angle between the line in the curved surface and a constant-Z curve segment drawn at constant distance from the plane, is equal to the angle between the developed line and a line parallel to the constant-Z curve segment. The development process can be defined more rigorously by the following mathematical approach.

(1) Let the curved three-dimensional surface be defined by the function S(x,y,z), where x, y and z are orthogonal coordinates.

(2) Furthermore, let there be a family of grid curves on the curved surface, where each line to be placed in the surface follows one of the grid curves, and the loci of the grid curves is defined by the function G(x,y,z).

(3) For purposes of demonstrating the process of development, select a specific grid curve $G_c(x,y,z)$ representing the centerline of a narrow strip to be developed from the curved surface S(x,y,z) onto a reference plane X'Y' parallel to the XY plane of the coordinate system. In general, the reference plane may have any orientation, but the one chosen here simplifies that mathematical description.

(4) Successive points in the selected grid curve are represented by $G_c(x_i,y_i,z_i)$, where $i=1, 2, 3, \ldots, I$. $G_c(x_i,y_i,z_i)$ defines the locus of the grid curve at the points i, and can be used to calculate successive vectors between points along the grid curve. In the practical process of development, the points i can be selected to be sufficiently close together that precise functional operations can be performed on the grid curve using finite difference approximations.

(5) The next step is to calculate the direction cosines of a constant-Z contour line in the curved surface, passing through each point i in the grid curve. The direction cosines are indicated by $\lambda_{iz}$, $\mu_{iz}$ and $\nu_{iz}$, and are the cosines of the angles between the constant-Z curve and the X, Y and Z directions, respectively. It will be apparent that, since the constant-Z curve does not vary in the Z direction, the cosine value $\nu_{iz}$ will be zero for all values of i.

(6) Similarly, the direction cosines of the grid curve at points i are represented by $\lambda_i$, $\mu_i$ and $\nu_i$.

The local vector of the grid curve at point i and the vector length, are indicated respectively by:

$\overline{i,i+1}$, $l_{i,\,i+1}$.

(7) The next step in the development of the curve is to calculate the dimensions of this local vector when folded or developed into the X'Y' plane. The x' and y' components of the developed vector length are given by the following two expressions:

$$\overline{y'_i\ y'_{i+1}} = l_{i,i+1} \cos(\alpha + \cos^{-1}\mu_{iz}),$$

$$\overline{x'_i\ x'_{i+1}} = l_{i,i+1} \sin(\alpha + \cos^{-1}\mu_{iz}),$$

where $\cos\alpha = \lambda_{iz}\lambda_i + \mu_{iz}\mu_i$.

(8) The entire developed curve can then be constructed using the following equations:

$$x'_i = x'_0 + \sum_{i=1}^{i} \overline{x'_i, x'_{i+1}},$$

$$y'_i = y'_0 + \sum_{i=1}^{i} \overline{y'_i, y'_{i+1}}.$$

In these equations, $x'_0$ and $Y'_0$ are selected arbitrarily and identify a location in the X'Y' plane at which the curved centerline $G'_c(x',y')$ is to be located.

Figure 9:
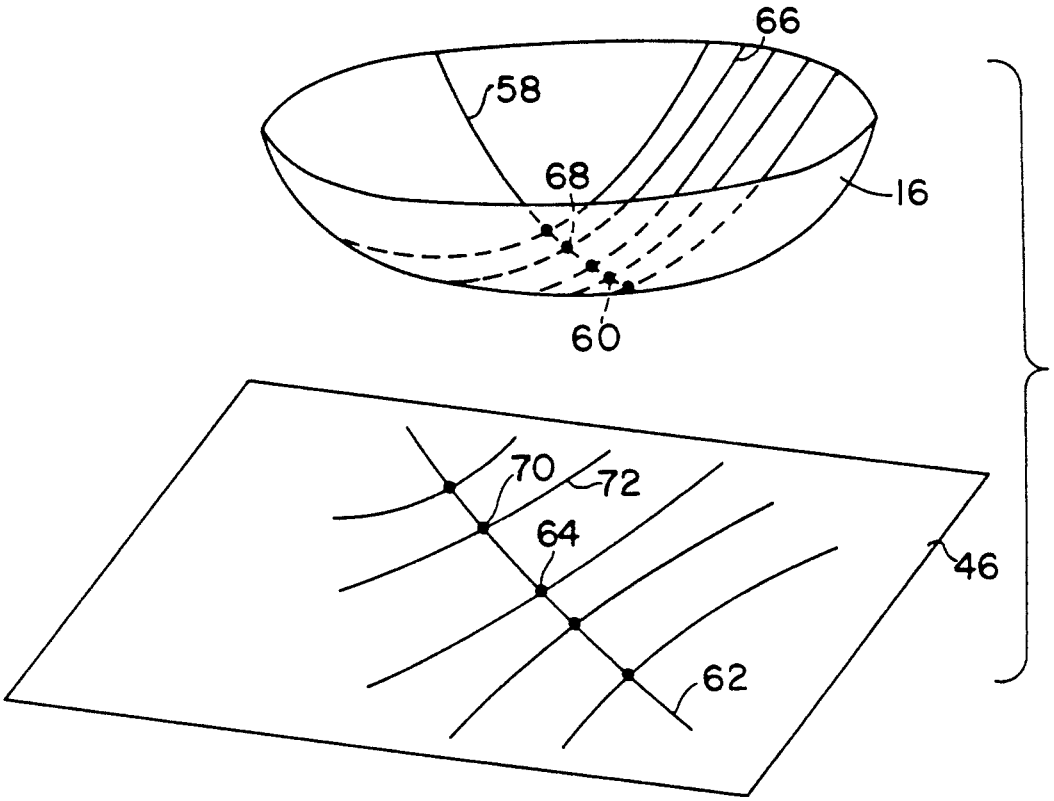
FIG. 9 is a diagrammatic view showing the use of an auxiliary line for properly orienting the developed lines or groups of lines.

FIG. 9 illustrates how multiple lines are developed from the curved surface 16 onto the reference plane 46. In the mathematical definition of the development process for a single line, the starting point $(x'_0, y'_0)$ for the developed line was selected arbitrarily. Since the lines are to be cut as strips from the reference plane, this approach may still be applied, with difficulty, if multiple lines are to be developed. However, a more practical approach for the development of multiple lines is the one illustrated in FIG. 9.

The approach is to locate each line to be developed by means of an auxiliary reference line 58 which intersects all of the lines to be developed. The line 58 is shown as passing through a point 60 on the curved surface, the point 60 being the closest point on the surface to the reference plane 46. This location of the reference line 58 is not necessary to the procedure. The reference line 58 is itself developed onto the plane 46, yielding the developed reference line 62. The point 60 corresponds to a point 64 in the developed reference line 62. Each line on the curved surface 16 is developed with reference to its intersection with the reference line 58. For example, line 66 intersects reference line 58 at point 68. The point 68 corresponds to point 70 on the developed reference line 62, and in the development of line 66 into developed line 72, the point 70 is used as a reference point to locate the developed line in the X'Y' plane. Similarly, the other lines are developed using their points of intersection with the reference line 58 as starting points for the development process.

The development process described above is performed for each line to be formed on the completed curved surface, and results in the definition of a large number of developed lines on the reference plane. These lines are then fabricated on the reference plane and cut from the plane as separate strip patterns.

From the foregoing, it will be appreciated that the present invention represents a significant advance in the field of composite shell construction. Although a preferred embodiment of the invention has been shown and described, it will be apparent that other adaptations and modifications can be made without departing from the spirit and scope of the invention. Accordingly, the invention is not to be limited, except as by the following claims.

I claim:

1. A laminated composite shell structure having improved thermoelastic properties, comprising:

multiple layers of overlapping strips of composite material conforming to an axisymmetric doubly-curved surface, the fibers in the multiple layers being arranged at different relative angular orientations;

wherein the composite strips are shaped to maintain the fibers at a constant relative angular orientation throughout the shell structure, thus providing a shell structure having quasi-isotropic thermal expansion and contraction characteristics.

2. The laminated composite shell structure as set forth in claim 1, wherein each composite strip includes multiple piecewise straight segments of composite material.

3. The laminated composite shell structure as set forth in claim 1, wherein the strips of composite material are strips of unidirectional graphite fiber reinforced epoxy tape.

4. A method for fabricating a laminated composite shell structure having improved thermoelastic properties, comprising the steps of:

generating a three-dimensional strip pattern that conforms to an axisymmetric doubly-curved surface and can be rotated any angle about the vertex of the curved surface relative to an identical fixed strip pattern with centerlines of the strips in the rotated pattern intercepting centerlines of the strips in the fixed pattern at the same angle and at the angle of rotation;

generating a planar strip pattern from the the three-dimensional strip pattern;

cutting multiple layers of composite strips using the planar strip pattern;

laying the composite strips in place on a three-dimensional mold to form multiple layers of overlapping composite strips, the fibers in the multiple layers being arranged at different relative angular orientations; and curing the composite strips;

wherein the composite strips are shaped to maintain the fibers at a constant relative angular orientation throughout the shell structure, thus providing a shell structure having quasi-isotropic thermal expansion and contraction characteristics.

5. The fabrication method as set forth in claim 4, wherein the step of generating a planar strip pattern includes the step of developing the three-dimensional strip pattern onto a planar surface.

6. The fabrication method as set forth in claim 4, wherein the step of generating a planar strip pattern includes the step of cutting the planar strip pattern directly on a three-dimensional mold of the shell structure having the three-dimensional strip pattern inscribed on its surface.

7. The fabrication method as set forth in claim 4, wherein the step of generating a three-dimensional strip pattern includes the step of generating a strip pattern on the curved surface such that the local angle of intersection between a plane at any angle Θ and each of a set of lines defining the strips is equal to the angle Θ that the plane makes with the X-axis of the strip pattern, the local angle of intersection being defined as the angle measured in the plane of tangency to the curved surface between a normal to the plane and the tangent to the line at the point of intersection, the plane including the vertex of the curved surface.

8. The fabrication method as set forth in claim 7, wherein the step of generating a three-dimensional strip pattern includes the step of varying Θ from 0° to 90° and constructing a set of lines on the doubly-curved surface that extend from initial positions on the surface in the XZ plane, each line being extended from its initial position by incrementally adding infinitesimal segments on the curved surface such that these segments intersect the plane at the angle Θ.

9. The fabrication method as set forth in claim 5, wherein the step of developing the three-dimensional strip pattern onto a planar surface includes the steps of:

generating successive line segments in a developed line corresponding to successive line segments in an original line in the curved surface;

maintaining the cumulative length of the developed line equal to the cumulative length of the original line; and ensuring that the angle between each segment of the original line and a local segment of a meridian curve drawn at a constant distance from the planar surface face is equal to the angle between the corresponding segment of the developed line and a line in the planar surface drawn parallel to the local segment of the meridian curve.

10. A method for developing a line in a curved surface onto a planar surface for fabricating a laminated composite shell structure having improved thermoelastic properties, comprising the steps of:

generating successive line segments in a developed line corresponding to successive line segments in an original line in the curved surface;

maintaining the cumulative length of the developed line equal to the cumulative length of the original line; and ensuring that the angle between each segment of the original line and a local segment of a meridian curve drawn at a constant distance from the planar surface is equal to the angle between the corresponding segment of the developed line and a line in the planar surface drawn parallel to the local segment of the meridian curve;

wherein the line in the planar surface is used for generating a planar strip pattern from a three-dimensional strip pattern that conforms to an axisymmetric doubly-curved surface and can be rotated any angle about the vertex of the curved surface relative to an identical fixed strip pattern, with centerlines of the strips in the rotated pattern intercepting centerlines of the strips in the fixed pattern at the same angle and at the angle of rotation.

* * * * *